United States Patent [19]

Nakamura et al.

[11] 4,302,404

[45] Nov. 24, 1981

[54] VARIABLE VENTURI CARBURETOR

[75] Inventors: Norihiko Nakamura, Mishima; Takashi Kato, Susono, both of Japan

[73] Assignee: Toyota Jidosha Kogyo Kabushiki Kaisha, Aichi, Japan

[21] Appl. No.: 80,116

[22] Filed: Sep. 28, 1979

[30] Foreign Application Priority Data

Oct. 20, 1978 [JP] Japan ..... 53-128328

[51] Int. Cl.[3] ..... F02M 9/06

[52] U.S. Cl. ..... 261/44 C; 261/DIG. 38

[58] Field of Search ..... 261/44 C, 44 B, DIG. 38

[56] References Cited

U.S. PATENT DOCUMENTS

| | | | |
|---|---|---|---|
| 2,394,663 | 2/1946 | Carlson et al. | 261/DIG. 38 |
| 2,914,307 | 11/1959 | Eickmann | 261/DIG. 38 |
| 3,278,173 | 10/1966 | Cook et al. | 261/50 A |
| 3,404,667 | 10/1968 | Mennesson | 261/44 C |
| 4,013,741 | 3/1977 | Edmonston | 261/44 B |
| 4,119,685 | 10/1978 | Itoh et al. | 261/44 C |
| 4,185,054 | 1/1980 | Nakamura et al. | 261/44 C |

FOREIGN PATENT DOCUMENTS

| | | | |
|---|---|---|---|
| 731782 | 2/1943 | Fed. Rep. of Germany | 261/44 B |
| 4729214 | 10/1968 | Japan | 261/44 B |
| 475332 | 12/1969 | Japan | 261/44 C |
| 488462 | 7/1938 | United Kingdom | 261/44 B |
| 1457503 | 12/1976 | United Kingdom | 261/44 C |
| 369289 | 3/1971 | U.S.S.R. | 261/44 C |

*Primary Examiner*—Tim R. Miles

*Attorney, Agent, or Firm*—Browdy and Neimark

[57] ABSTRACT

A variable venturi carburetor wherein the suction piston is fully closed with respect to the venturi section at engine stop to elevate the negative pressure at the time of cranking, and is opened to a predetermined degree at the time of idling, thereby obtaining stable driving performance at a suitable air-fuel ratio. The suction piston slides, via a spring, into and out from a suction chamber communicating with a mixing chamber via a negative pressure path and has at its head a metering needle to face a metering jet. The low negative pressure occurring in the mixing chamber along with cranking is reliably applied to the gap between the metering needle and the metering jet which is wider than the gap in their matching state at the time of idling. Hence, the engine starts operating with an over-rich air-fuel ratio. The suction piston is shaped in such manner so as to close a venturi section on the upstream side with respect to the base portion of the metering needle at the time of stop of the engine. A venturi-crossing flange is disposed at a location corresponding to the position in the venturi section of either one or both of the suction piston head and a barrel member of the above-mentioned venturi section. Alternatively, an atmospheric pressure is communicated with the negative pressure to the suction chamber in order to enable driving at a set air-fuel ratio with a suitable lift movement.

9 Claims, 12 Drawing Figures

Fig 2
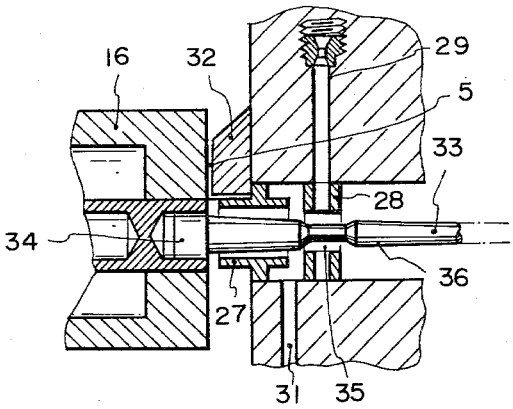
Fig 3
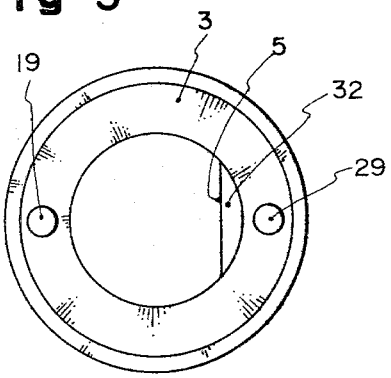
Fig 4
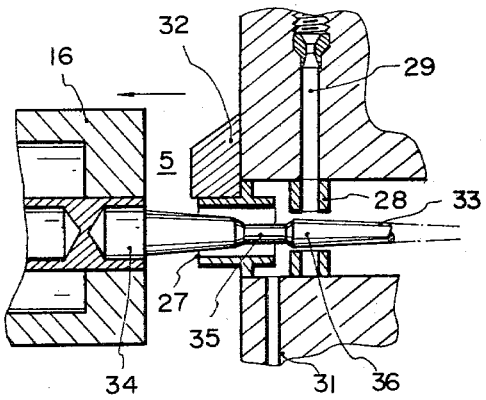
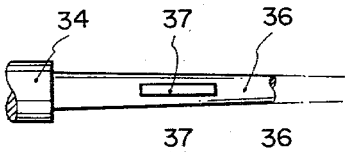
Fig 5a
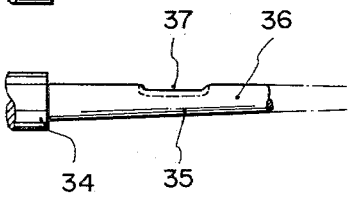
Fig 5b

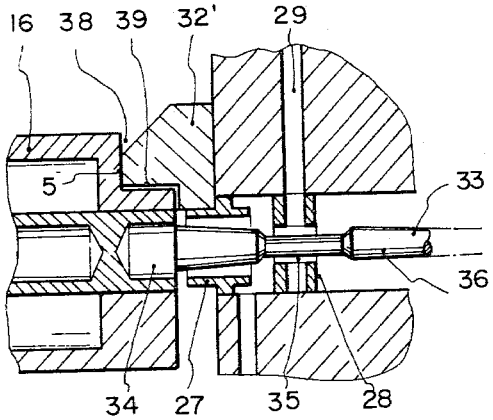
Fig 6
Fig 7a
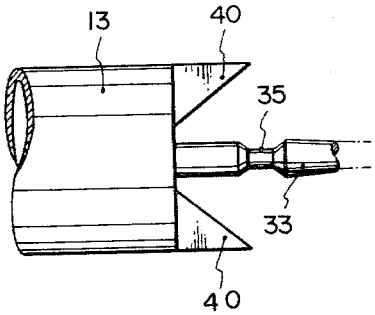
Fig 7b
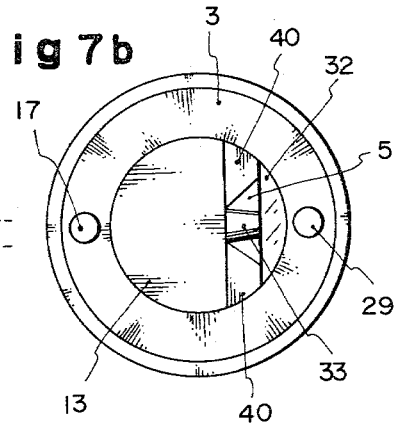
Fig 7c
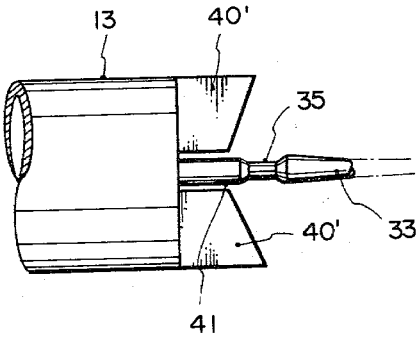

VARIABLE VENTURI CARBURETOR

BACKGROUND OF THE INVENTION

In a so-called SU-type variable venturi carburetor, this invention relates to a carburetor wherein a negative pressure of a mixing chamber is communicated with a suction chamber in order to cause change in the cross-section of a venturi section by means of a suction piston sliding in the suction chamber under correlationship between spring balance and leak operation gas pressure, and a metering is provided to the head of the suction piston so as to face a metering jet. More specifically, the present invention relates to a variable venturi carburetor of the type wherein the suction piston closes the venturi section at engine stop so as to elevate a negative pressure at the time of low temperature cranking and thus to ensure easy intake for the engine and enrichment of an air-fuel mixture, and wherein the gap between the metering needle and the metering jet is made greater at the time of engine stop than at the time of idling and a lift movement prior to idling is made small while a lift movement at the time of idling is made relatively large.

As is well known in the art, in a carburetor of an engine, various kinds of fixed- and variable-venturi carburetors have been developed. Due to various advantages of the variable venturi carburetor such as good response characteristics to the change in an air-fuel mixture, absence of a branching system of a slow system and a main system and so forth, the variable venturi carburetor has gradually been installed to cars at large, ranging initially from some sport cars to passenger cars in general.

However, there are various problems yet to be solved in the variable venturi carburetor. Among them is a troublesome procedure for supply and viscosity adjustment of oil for an oil damper which is in principle provided in order to restrict self-excitation and overshoot of the carburetor. To solve this drawback, there has been developed and actually installed an excellent variable venturi carburetor of an oil damper-less type having a gas-responsive mechanical design such as disclosed, for example, in the Applicant's previous Japanese Patent Application No. 94534/1978.

Even in the oil damper-less type variable venturi carburetor, a kind of limited fixed venturi construction is employed wherein a stopper is generally added to the barrel of the venturi section to avoid perfect closing of the suction piston in order to stabilize an air-fuel ratio in the range of a small air feed quantity occurring during the low negative pressure period from the time of low temperature cranking at the start of the engine till idling.

Consequently, it follows naturally that during the low temperature cranking or idling, the negative pressure does not rise up to a predetermined level and suction of the gasoline from the main nozzle becomes insufficient as much, thereby failing to provide an over-rich air-fuel ratio. To cope with this problem, a choke valve is therefore disposed on the upstream side of the venturi section to elevate the negative pressure while a starter nozzle is interposed between the choke valve and the suction piston, so as to increase the amount of gasoline when the choke valve is operated.

However, the abovementioned counter-measure increases inevitably the height of the carburetor by the height of the choke valve and thus leads to the problem in that the height of the engine room of a sport car or the like increases as much eventually. In addition to the complicated construction due to the provision of the starter nozzle, there occurs another problem such as insufficient power or unstable driving performance because low temperature acceleration and warming-up driving must be controlled by the single choke valve. If a control- or adjustment-mechanism is added so as to compensate for these drawbacks, there occur again such problems as a still further complicated construction, increase in the cost of production and troublesome maintenance.

SUMMARY OF THE INVENTION

In view of the abovementioned problems in the conventional limited, fixed venturi system including the choke valve and the starter nozzle added to the suction piston on the basis of the prior art, the present invention is directed to provide a novel variable venturi carburetor wherein the suction piston is fully closed in principle with respect to the venturi section at engine stop to elevate the negative pressure at the time of cranking, and is opened to a predetermined degree at the time of idling, thereby obtaining stable driving performance at a suitable air-fuel ratio.

BRIEF DESCRIPTION OF THE DRAWINGS

FIG. 2 is a partial enlarged schematic view of the first embodiment;

FIG. 3 is a schematic view of the upper face of the venturi section;

FIG. 4 is a schematic view useful for explaining the first embodiment of FIG. 2 at the time of idling;

FIGS. 5*a* and 5*b* are schematic views useful for explaining the upper face in part and the side face of the metering needle, respectively;

FIG. 6 is schematic view of another embodiment corresponding to the embodiment shown in FIG. 2;

FIGS. 7*a* and 7*b* are schematic views useful for explaining the suction piston of another embodiment and its action, respectively;

FIG. 7*c* is a schematic view showing still another embodiment of the suction piston of FIG. 7*a;*

DETAILED DESCRIPTION OF THE PREFERRED EMBODIMENTS

Figure 1:
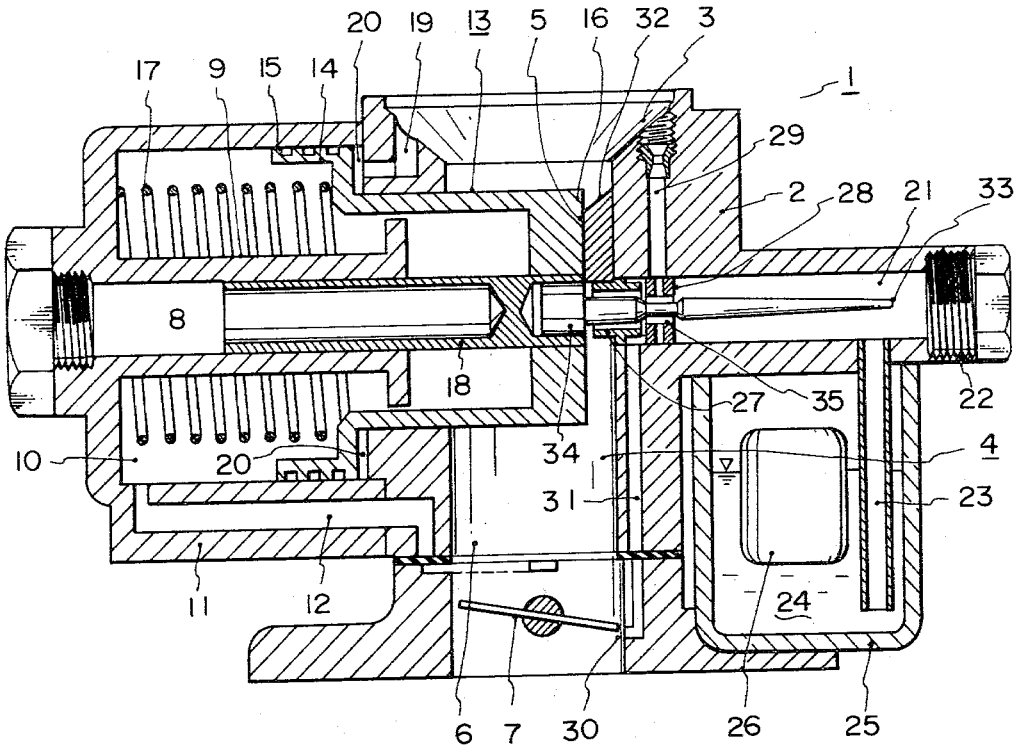
FIG. 1 is a longitudinal sectional view useful for explaining the first embodiment of the invention as a whole.

In the embodiments shown in FIGS. 1 through 4, reference numeral 1 represents an oil-damperless variable venturi carburetor and a reversely truncated conical suction bore 3 and a cylindrical, hollow barrel 4 continuing the bore 3 are bored at the upper portion of the casing 2 of the carburetor. On the downstream side of the barrel 4, there is formed a mixing chamber 6 with a venturi section 5 being as its center, and a throttle valve 7 is disposed below the mixing chamber 6.

To one side of the casing 2 is secured a housing 11 in which a suction chamber 10 is defined. A bush 9 having a guide hole 8 bored at its center extends inside the housing 11. The suction chamber 10 is communicated with the mixing chamber 6 by a negative pressure path 12 and is slidably fitted thereto through a labyrinth 15 at the flange section 14 of a suction piston 13 or through a choke orifice (not shown) in such a manner as to allow the passage of the air. A return spring 17 is interposed between the rear face of the suction piston 13 and the inner face of the housing 11, and a rod 18 pushed under prressure into the head 16 is inserted into the guide hole 8.

Reference numeral 19 represents an air communication hole which is open to the suction bore 3 of the casing 2 and communicates with an air chamber 20 between the front face of the flange section 14 of the suction piston 13 and the casing 2.

A housing 22 having a nozzle hole 21 is disposed on the other side of the casing 2. On the extension of this housing 22 is disposed a float chamber 25 which incorporates therein a float 26 and includes a suction pipe 23 to face the inner bottom portion of the gasoline 24.

The nozzle hole 21 is positioned at the center of the suction piston 13 and has, at its base portion, a main nozzle 27. A metering jet 28 inside the main nozzle 27 communicates with an air bleed 29 which is open to the suction bore 3.

Reference numeral 30 represents an idle port which is open and opposes to the throttle valve 7 and communicates with the rear portion of the main nozzle 27 via an idle path 31.

Reference numeral 32 represents a bridge which forms one of the gists of the present invention. This bridge is secured on the upstream side of the main nozzle 27, and the front face of the head 16 of the suction piston 13 comes into intimate contact with the bridge 32 at the time of halt of the engine and thereby closes the venturi section 5.

A metering needle 33, that forms another gist of the present invention, is fitted to the center of the head 16 of the suction piston 13, that is, by pressing its base 34 into the tip of the rod 18 and is implanted so that it is centered with respect to the main nozzle 27 and the metering jet 28.

The metering needle 33 is tapered from its base to its tip with a designed degree of taper. A narrow sectional area portion 35 is defined at a portion of the needle 33 which comes to correspond to the above-mentioned metering jet 28 while the engine is at halt or while the head 16 of the suction piston 13 is under intimate contact with the bridge 32, as shown in FIGS. 2 and 4, so that the gap between it and the metering jet 28 becomes greater. This portion 35 has a sectional area smaller than that of an idle portion 36 at its tip.

The narrow sectional area portion 35 is shown exaggerated in these drawings for the illustration purpose. However, this may be shaped in the parallel form to extend up to the idle portion 36. Alternatively, a notch 37 may be defined as shown in FIGS. 5*a* and 5*b* so that the outer shape of the portion 35 is shaped in the form of a normal taper.

As to the size of the narrow sectional area portion 35 in the axial direction, design is to be suitably made so that when a lift movement of the head 16 of the suction piston 13 relative to the bridge 32 becomes idle lift, the portion 35 comes off from the metering jet 28 and the idle portion 36 of the netering needle 33 corresponds to the metering jet 28.

In the above-described construction, FIGS. 1, 2 and 3 illustrate the state where the engine is at halt, respectively. When the engine start is carried out from this engine stop state by means of a starter via an ignition key and low temperature cranking is initiated, the head 16 of the suction piston 13 strikes the bridge 32 and closes the venturi section 5 as described already. Accordingly, though in the low speed cranking, a negative pressure is reliably generated in the mixing chamber 6.

The negative pressure occurring in the mixing chamber 6 at the time of cranking start functions to generate a suction negative pressure in the relatively large gap between the metering jet 28 and the narrow sectional area portion 35 of the metering needle 33 whereby an air-fuel mixture having a rich ratio is sucked from the main nozzle 27 into the mixing chamber 6 in accordance with the design sizes of the narrow sectional area portion 35, the metering jet 28, the air bleed 29 and the main nozzle 27.

Hence, the idle state is attained in a reliable manner at the time of cranking start even if the number of crankings is small from the perfectly closed state of the venturi section 5 of the suction piston 13.

On the other hand, the negative pressure occurring in the mixing chamber at the start of cranking in the abovementioned manner functions to produce a negative pressure in the suction chamber 10 via the negative pressure path 12 whereby the suction piston 13 is sucked due to its balance with the spring 17, thereby producing a lift.

After the shift to the idle state, the variable venturi section 5 is defined between the head 16 of the suction piston 13 and the bridge 32 due to the balance of this negative pressure with the spring 17 and to the leak gas pressure of the orifice, the choke and so forth, thus producing the venturi negative pressure.

During this idle process, the idle portion 36 of the metering needle 33, or the large sectional area portion adjacent the narrow sectional area portion 35, comes to move into the metering jet 28 along with retreat of the metering needle 33 which follows the retreat of the suction piston 13 whereby the gap between the metering needle 33 and the metering jet 28 becomes smaller. Accordingly, the air-fuel mixture is prevented from becoming over-rich and the air-fuel mixture having a predetermined air-fuel ratio is sucked into the mixing chamber 6, thereby enabling to maintain suitable idling.

Once the idle state is attained, the negative pressure inside the mixing chamber under the idle state increases. Hence, the negative pressure inside the suction chamber 10 also increases via the negative pressure path and the lift movement increases. Prevention of self-excitation and that of over-shoot during this period are carried out by the spring 17 in mutual cooperation with the air chamber 20, the suction negative pressure and the labyrinth 15. The action of these members is disclosed in detail in, for example, Japanese patent Application No. 94534/1978 filed previously by the applicant of the present invention.

It is also possible to obtain an air-fuel mixture having a rich air-fuel ratio at the time of start or cranking by allowing the narrow sectional area portion 35 of the metering needle 33 to reliably come to the position corresponding to the metering jet 28. However, this might lead to such a shortcoming that a lift movement remains too small at the time of idling, with the narrow sectional area portion 35 remaining at the position corresponding to the metering jet 28 at the time of cranking, or on account of error during assembly. To cope with such a problem, the following may be employed. Namely, as shown in FIG. 6, a recess 38 is formed at the upper tip portion of the head 16 of the suction piston 13 while a bridge 32' is applied to form an overlap slide portion 39 at the slit 38 in accordance with a preferred arrangement. This arrangement makes greater the difference between the lift movement at the time of cranking and that at the time of idling. Even if there is any deviation during assembly, this preferred arrangement enables the small sectional area portion 35 of the metering needle 33 to reliably move from over the metering jet 28 and allows the idle portion 36 to take its place, thereby preventing the engine trouble due to the over-rich air-fuel mixture at the time of idling.

In the embodiment shown in FIGS. *7a* and *7b*, design of the head 16 of the suction piston 13 is such in the same way as in the embodiment shown in FIGS. 1 through 4, that the head 16 is applied to the bridge 32 to seal it at the start of cranking, and a pair of flanges 40, 40 are formed to extend from the head 16 so that the lift movement at the time of idling is made greater than that at the time of cranking. This arrangement enables one to prevent the over-rich air-fuel mixture at the time of idling and to provide the same effect as in the embodiment shown in FIG. 6.

In the abovementioned embodiment, the rim shapes of the inner edge of the flanges 40, 40 are linear with a predetermined angle between them in accordance with the interrelationship between the narrow sectional area portion 35 of the metering needle 33, the size of the meter-jet 28 and the venturi section 5. It is possible to let the rim shape extend along the curve of a quadratic function, the curve of a trigometrical function or the curve of an exponential function. Furthermore, it is possible to employ such a design wherein the relative angle between the rims of the inner edges of the pair of flanges 40', 40' is made open widely and parallel slits 41 are interposed between the base portions of these flanges 40', 40' as shown in FIG. *7c* so as to reduce the lift at the time of cranking and to increase the lift at the time of idling. These flanges may be formed on the side of the bridge 32 so as to extend towards the bridge.

Figure 8:
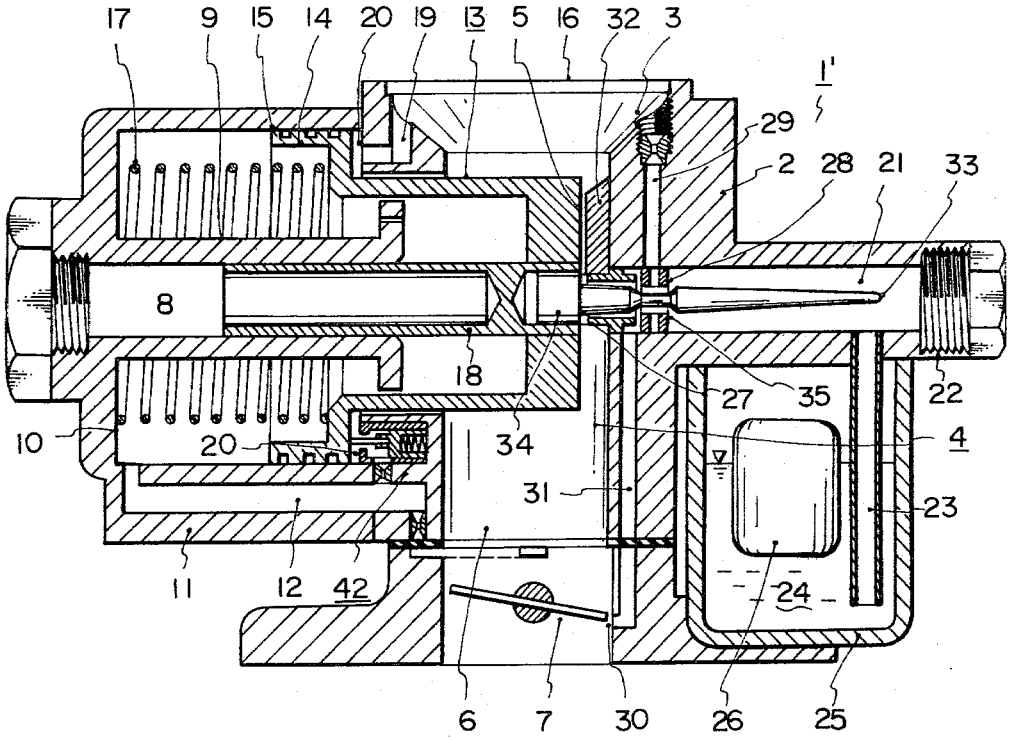
FIG. 8 is a longitudinal sectional view of a still another embodiment corresponding to the embodiment of FIG. 1.
Figure 9:
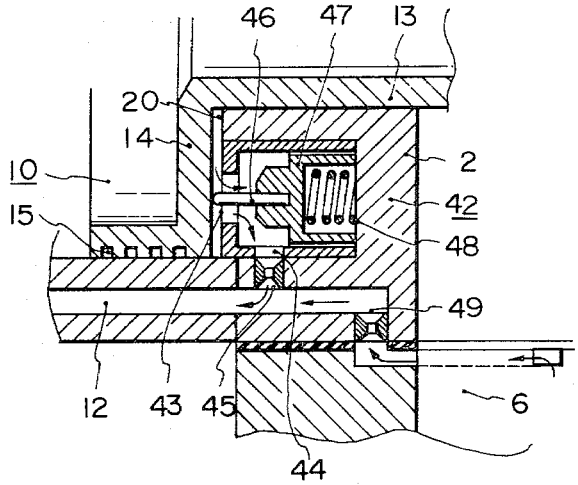
FIGS. 9 and 10 are partial enlarged view and a schematic view useful for explaining the embodiment of FIG. 8 and its idle state, respectively.
Figure 10:
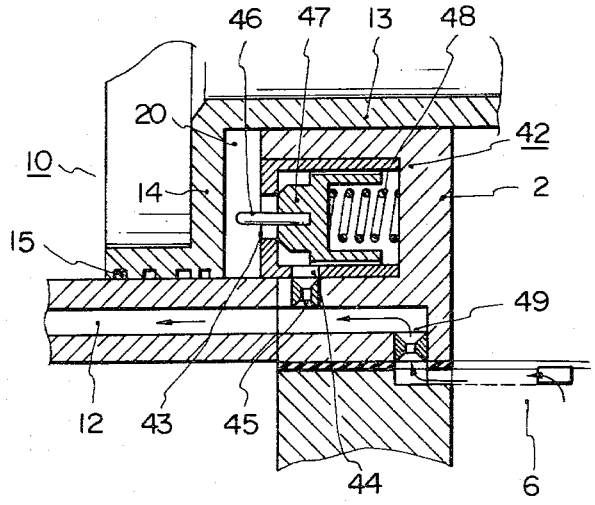

In the embodiment shown in FIGS. 8, 9 and 10, an operation valve 42, which opens at a low negative pressure and communicates with the air chamber 20 and with the negative pressure path 12, is additionally provided to the portion of the side wall casing 2 of the mixture chamber 6 of the embodiment shown in FIGS. 1 through 4. The casing includes a casing having a communication hole 43 to open to the air chamber 20 and also having a communication hole 44 to communicate with the negative pressure path 12 and to face an orifice 45. An operation piston 47 has a push rod 46 which extends from the front portion of the piston and is able to come into, and out of, contact with the flange 14 of the suction piston 13. This piston 47 is incorporated in the casing in such a manner that it is centered with respect to the communication hole 43 and is allowed to slide via a return spring 48.

At start or at the time of start of cranking, therefore, the air from the air communication hole 19 enters the air chamber 20 as shown in FIG. 9 and the flange 14 of the suction piston 13 which takes the fully closed posture or the posture near the fully closed posture causes the push rod 46 to retreat against the return spring 48 so that the operation piston 47 opens the communication holes 43 and 44. Consequently, the air chamber 20 is communicated with the negative pressure path 12 and the incoming atmospheric pressure from the air chamber 20 weakens the negative pressure of the mixing chamber 6 flowing through the orifice 49 and the negative pressure path and acting on the suction chamber 10. Hence, the narrow sectional area portion 35 of the metering needle 33 is caused to correspond to the metering jet 28 so that the rise of the negative pressure inside the suction chamber 10 is restricted, the slide-back of the suction piston 13 is restrained and the lift movement is relatively reduced thereby to provide a dense air-fuel mixture.

After the shift to the idling, the communication negative pressure in the negative pressure path 12 exhibits a rapid increase along with the rise of the negative pressure of the mixing chamber 6. Hence, restriction of the air from the air chamber 20 is relatively reduced and hence, the negative pressure from the suction chamber 10 rises, whereby the suction piston 13 retreats so as to form an idle lift in accordance with the set balance.

In consequence, the operation piston 47 is caused to advance by means of the push force of the return spring 48 together with the push rod 46. During the idle process, it finally closes the communication hole 43. As the hole 43 is closed, the negative pressure inside the suction chamber 10 increases rapidly and the lift movement changes rapidly to the idle state or to a suitable lift. Consequently, the idle portion 36 of the metering needle 33 is caused to immediately move into the metering jet 28 so as to avoid the over-rich air-fuel mixture.

Accordingly, in this embodiment, too, the full closing of the venturi section 5, the small lift and the medium lift can be suitably established at the time of cranking and idling.

Incidentally, in the embodiment shown in FIGS. 8, 9 and 10, a suitable electromagnetic valve may be interposed between the communication holes 43 and 44 in order to control the negative pressure by communicating the air chamber 20 with the suction chamber 10 during the cranking process in which the starter is operating. Alternatively, an air suction electromagnetic valve may be added to the suction chamber 10 itself.

It goes without special noting that the invention of the present application is not specifically limited to the above-described embodiments but can be adapted to the conventional oil damper system SU carburetor.

As described above, the present invention is fundamentally constructed in such a manner that the suction piston of the variable venturi closes fully the venturi section at the time of stop of the engine. According to this construction, the negative pressure is reliably produced inside the mixing chamber at the time of operation of the starter and sucks the air-fuel mixture of the metering needle and the metering jet. Hence, even without using additionally the choke valve and the starter nozzle, the present invention provides various excellent advantages such as simplification of the construction, lowering of the height, reduction of the cost of production and lowering of the height of the car.

The present invention also provides such an excellent advantage as the improvement in the low temperature start capacity at the time of cranking, and an outstanding advantage in that since it is free from unstable operation of the choke valve due to elimination of the choke valve, the operation performance in the rapid acceleration becomes extremely improved at the time of warming-up driving of the engine.

Further, on the metering needle formed to extend from the suction chamber head, the portion of the metering needle which comes to correspond to the metering jet when the engine is at halt, that is, when the venturi section is fully closed, is shaped to have the sectional shape smaller than that at the time of idling so that the dense air-fuel mixture having a high air-fuel ratio from the main jet is sucked at the time of cranking, thereby improving the startability. In addition, this arrangement provides the effect in that fast idling can directly be effected by sucking the rich air-fuel mixture at the time when small lift is made at the time of operation of the starter from the state where the venturi section is fully closed.

Still further, the venturi-crossing flange is disposed on at least one of the suction piston head and the venturi barrel to extend therefrom. This arrangement enables to make the lift movement of the idle state with respect to that of the cranking state relatively large, thereby enabling to avoid the over-rich air-fuel mixture in the idle state and to obtain stable idling. Hence, it is also possible to employ effective measures for coping with the exhaust gas using a suitable air-fuel mixture ratio.

Since the operation valve which operates at a low negative pressure and communicates with the air chamber is interposed in the negative pressure path communicating with the suction chamber, it is possible to minimize the lift of the suction piston at the time of cranking. From this point, too, it is possible to make the most of the negative pressure with respect to the main jet at the time of cranking so as to enable suction of the rich air-fuel mixture having a cranking demand air-fuel ratio. The air-fuel ratio is shifted to the idling air-fuel mixture ratio by the rapid increase in the lift due to the rapid retreat of the suction piston which is caused by the rapid increase in the negative pressure at the time of idling, thereby to obtain the stable driving performance and the air-fuel ratio free from pollution.

Installation of the variable venturi carburetor in accordance with the present invention which does not include the choke valve and the starter nozzle is free from unstable operation of the choke during low temperature cranking, idle driving and warming-up, does not cause insufficiency of the power at the time of acceleration and this ensures stable driving.

What is claimed is:

1. In a variable venturi carburetor having such a construction wherein a suction piston slides via a spring into and out from a suction chamber communicating with a mixing chamber via a negative pressure path and has at its head a metering needle to face a metering jet, the improvement wherein said suction piston is shaped in such a fashion as to close a venturi section on the upstream side with respect to the base portion of said metering needle at the time of stop of an engine, and said metering needle is tapered from its base portion to its tip and its section at the time of stop of the engine is made smaller than that at the time of idling.

2. The variable venturi carburetor as defined in claim 1 wherein a reduced diameter portion is formed on said metering needle at a position that corresponds to said metering jet when the engine is at halt.

3. The variable venturi carburetor as defined in claim 1 wherein a notch is disposed in the axial direction on said metering needle at a position that corresponds to said metering jet when the engine is at halt.

4. The variable venturi carburetor according to claim 1 wherein said suction piston is shaped in such a fashion as to close a venturi section on the upstream side with respect to the base portion of said metering needle at the time of stop of an engine, and a venturi-crossing flange is disposed on at least either one of said suction piston head and a barrel of said venturi section.

5. The variable venturi carburetor as defined in claim 4 wherein said flange is shaped in the form of a taper.

6. The variable venturi carburetor as defined in claim 5 wherein a pair of said flanges are disposed via parallel slits.

7. The variable venturi carburetor according to claim 1 wherein said suction piston is shaped in such a fashion as to close a venturi section on the upstream side with respect to the base portion of said metering needle at the time of stop of an engine, and an air chamber is equipped with an operation valve so as to communicate with said negative pressure path, said operation valve opening when the negative pressure is low.

8. The variable venturi carburetor as defined in claim 7 wherein said operation valve includes a push rod engaging with said suction piston and is able to open and close a communication hole communicating with said air chamber.

9. The variable venturi carburetor as defined in claim 7 wherein said operation valve is an electromagnetic valve.

* * * * *